US006425654B1

(12) United States Patent
Silverbrook

(10) Patent No.: US 6,425,654 B1
(45) Date of Patent: Jul. 30, 2002

(54) INK JET PRINT HEAD WITH TAPERED NOZZLE CHAMBERS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/458,498

(22) Filed: Dec. 11, 1999

(30) Foreign Application Priority Data

Jan. 15, 1999 (AU) ..... PP8231

(51) Int. Cl.[7] ..... B41J 2/135
(52) U.S. Cl. ..... 347/44
(58) Field of Search ..... 347/20, 54, 56, 347/27, 9, 32, 57, 44–47; 400/120.16, 120.17; 438/21

(56) References Cited

U.S. PATENT DOCUMENTS 4,459,600 A * 7/1984 Sato et al. ..... 347/47
6,071,750 A * 6/2000 Silverbrook ..... 438/21
6,084,616 A * 7/2000 Nakata ..... 347/65
6,171,875 B1 * 10/2000 Silverbrook ..... 438/21
6,180,427 B1 * 1/2001 Silverbrook ..... 438/21
6,188,415 B1 * 2/2001 Silverbrook ..... 347/54
6,209,989 B1 * 4/2001 Silverbrook ..... 347/54
6,247,790 B1 * 6/2001 Silverbrook ..... 347/20

* cited by examiner

*Primary Examiner*—John Barlow
*Assistant Examiner*—K. Feggins

(57) ABSTRACT

The nozzle chamber of an inkjet print head of the type having a paddle moving within the chamber, is provided with sloping side walls arranged such that the gap between the periphery of the paddle and the chamber walls increases from the quiescent to the forming position. This facilitates rapid refilling of the chamber after firing and higher speed of operation.

3 Claims, 4 Drawing Sheets

INK JET PRINT HEAD WITH TAPERED NOZZLE CHAMBERS

FIELD OF THE INVENTION

The present invention relates to ink jet printing and, in particular, discloses a nozzle arrangement for an ink jet printhead.

BACKGROUND OF THE INVENTION

Many different types of printing have been invented, a large number of which are presently in use. The known forms of printers have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Ink Jet printers themselves come in many different types. The utilisation of a continuous stream ink in ink jet printing appears to date back to at least 1929 wherein U.S. Pat. No. 1,941,001 by Hansell discloses a simple form of continuous stream electrostatic ink jet printing.

U.S. Pat. No. 3,596,275 by Sweet also discloses a process of a continuous ink jet printing including the step wherein the ink jet stream is modulated by a high frequency electrostatic field so as to cause drop separation. This technique is still utilized by several manufacturers including Elmjet and Scitex (see also U.S. Pat. No. 3,373,437 by Sweet et al).

Piezo-electric ink jet printers are also one form of commonly utilized ink jet printing device. Piezo-electric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezo electric crystal, Stemme in U.S. Pat. No. 3,747,120 (1972) discloses a bend mode of piezo-electric operation, Howkins in U.S. Pat. No. 4,459,601 discloses a Piezo electric push mode actuation of the ink jet stream and Fischbeck in U.S. Pat. No. 4,584,590 which discloses a sheer mode type of piezo-electric transducer element.

Recently, thermal ink jet printing has become an extremely popular form of ink jet printing. The ink jet printing techniques include those disclosed by Endo et al in GB 2,007,162 (1979) and Vaught et al in U.S. Pat. No. 4,490,728. Both the aforementioned references disclosed ink jet printing techniques relying upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Recently, in Australian Provisional Patent Specification No. PP6534 filed Oct. 16, 1998 entitled "Micromechanical Device and, Method (IJ46a)" filed by the assignee of the present application, the contents of which are incorporated herein by way of cross reference, an ink jet printing system was disclosed having a series of chambers, each with a ink ejection nozzle aperture in one wall of the chamber. A moveable paddle activated by a thermal bend actuator is disclosed such that movement of the paddle causes a resultant ejection of ink from the chamber. The ink is then refilled via means of surface tension drawing fluid into the chamber.

In any printing arrangement, it is often desirable to operate the print head at a maximum throughput speed. In an ink jet printing arrangement, the limiting factor in the speed of operation is often the refill time of the chamber. It is desirable to provide as rapid a refill of the chamber as possible.

SUMMARY OF THE INVENTION

The present invention therefore provides a nozzle arrangement for an ink jet printhead, the nozzle arrangement comprising:

side walls and a roof wall that define an ink chamber and a nozzle aperture defined in the roof wall for the ejection of ink, the side walls and the roof wall being configured so that a cross sectional area of the ink chamber increases continually towards the nozzle aperture; and a moveable paddle that is positioned within said chamber, said paddle being displaceable between a first distal position and a second proximal position with respect to the nozzle aperture to eject ink from the nozzle aperture.

Preferably, said side walls define a divergent profile.

Preferably, the nozzle arrangement is the product of an integrated circuit fabrication technique which includes a re-entrant etching process carried out on a sacrificial layer utilized in forming said side and roof walls.

BRIEF DESCRIPTION OF THE DRAWINGS

Notwithstanding any other forms which may fall within the scope of the present invention, one preferred form of the invention will now be described, by way of example only, with reference to the accompanying drawings in which.

DESCRIPTION OF PREFERRED EMBODIMENT

In the preferred embodiment the teachings of the aforementioned Australian provisional patent specification PP6534 are adapted so as to carefully profile the walls of the fluid chamber by utilizing re-entrant etching techniques so as to provide for rapid refill of a chamber after the firing of an ink jet drop.

Turning initially to FIGS. 1–4, there is illustrated the operation of the ink ejection nozzle of aforementioned prior art provisional patent specification. In this ink ejection apparatus, a fluid chamber 1 is defined by walls 2, typically to a cylindrical shape, and a nozzle aperture 3 is provided such that in use an ink meniscus 4 is formed across the aperture. The chamber 1 is typically formed utilizing semiconductor deposition etching techniques and MEMS (Micro-Electro Mechanical System) processing techniques as described in detail in the aforementioned provisional patent specification.

Figure 1:
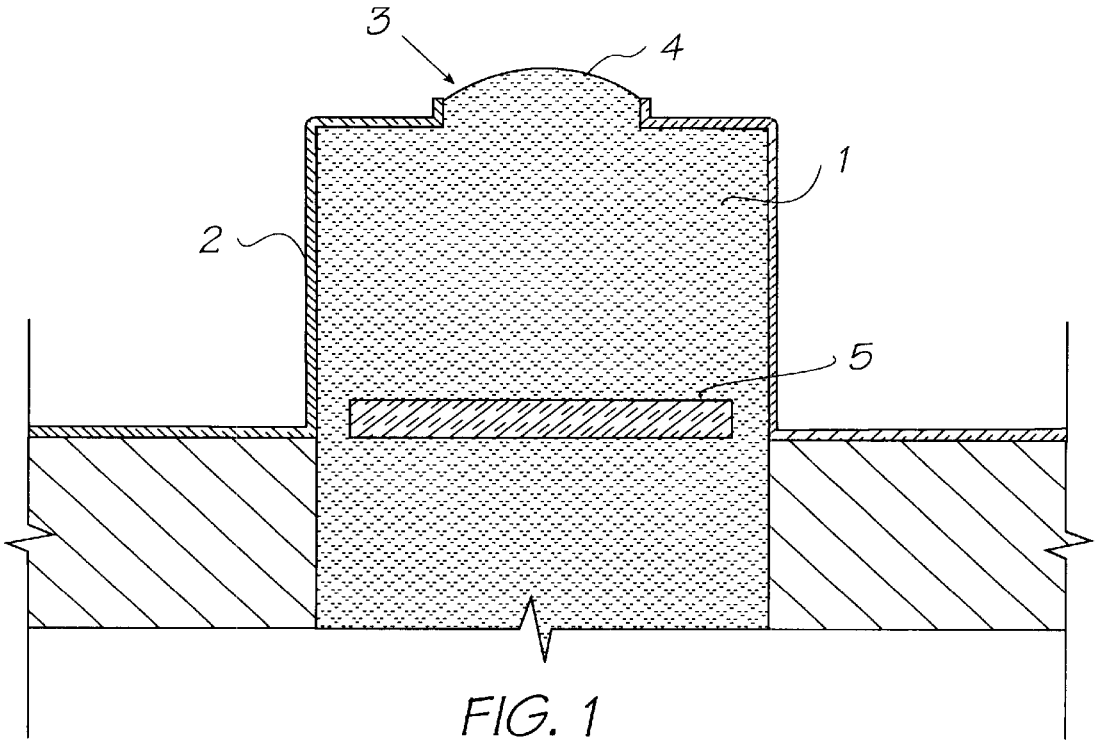
FIGS. 1–4 are diagrammatic sectional elevations of the progressive operation of a fluid ejection system according to the prior art.
Figure 2:
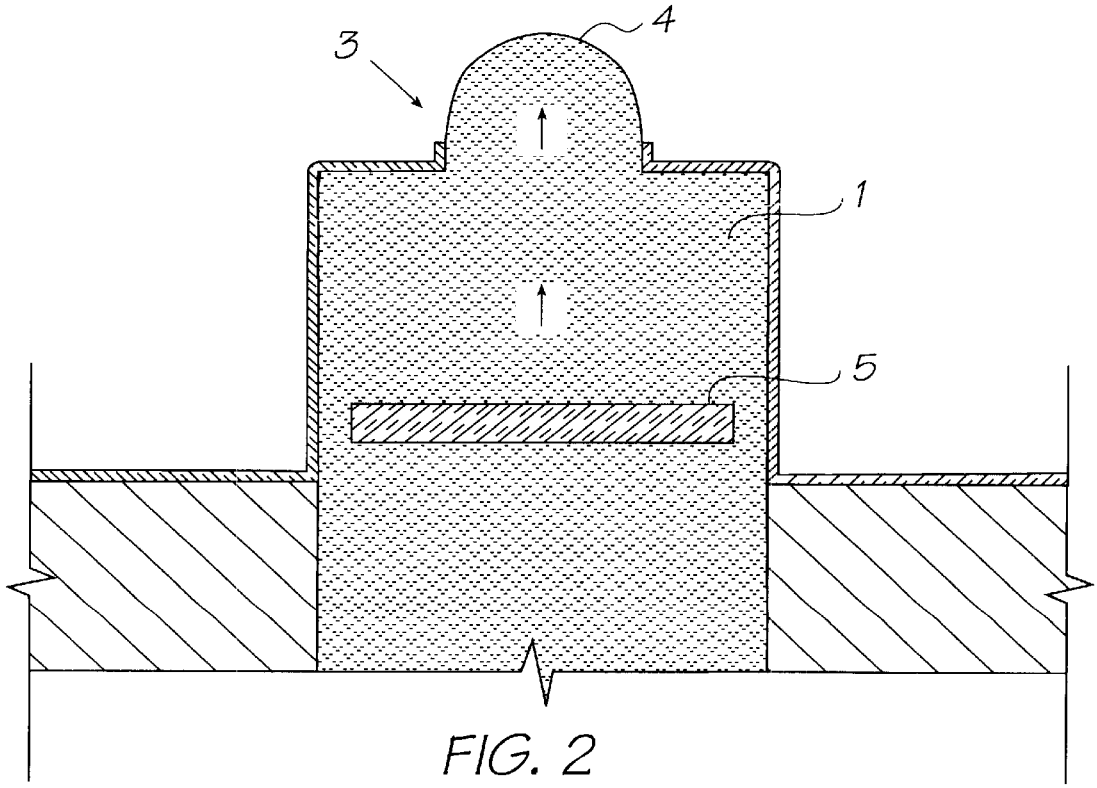
Figure 3:
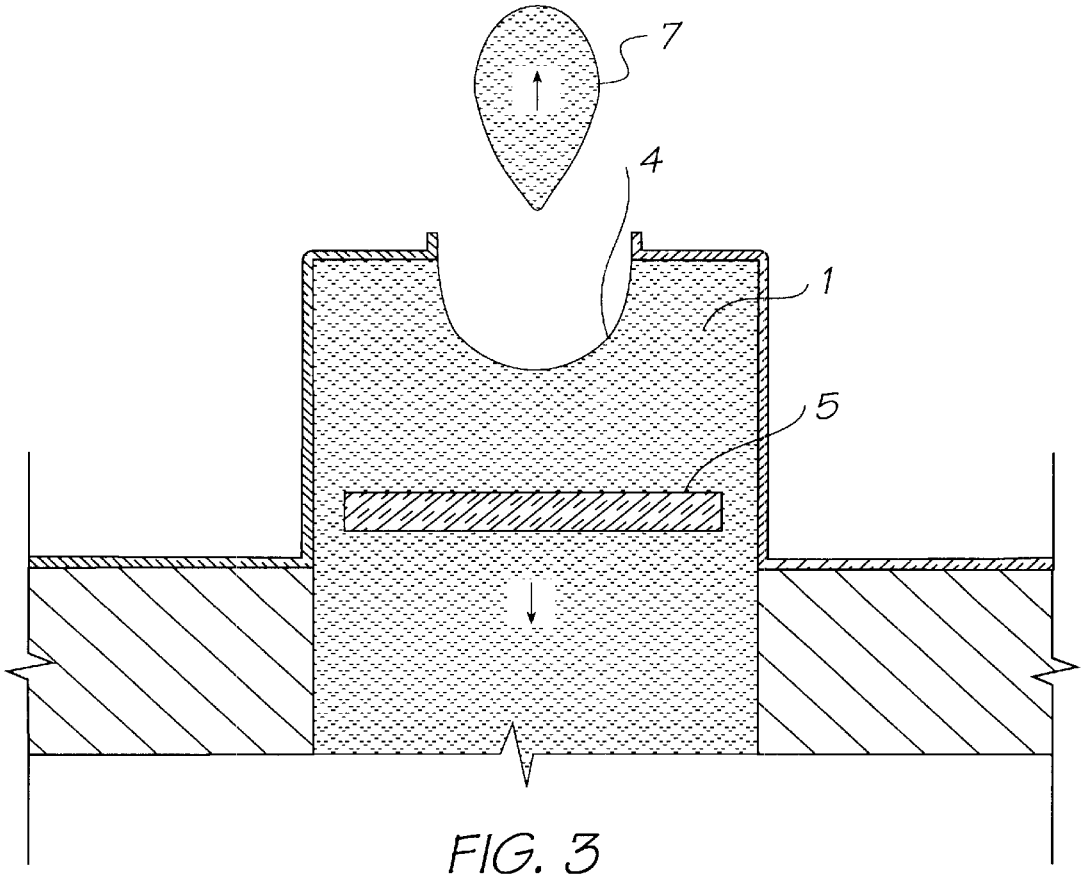
Figure 4:
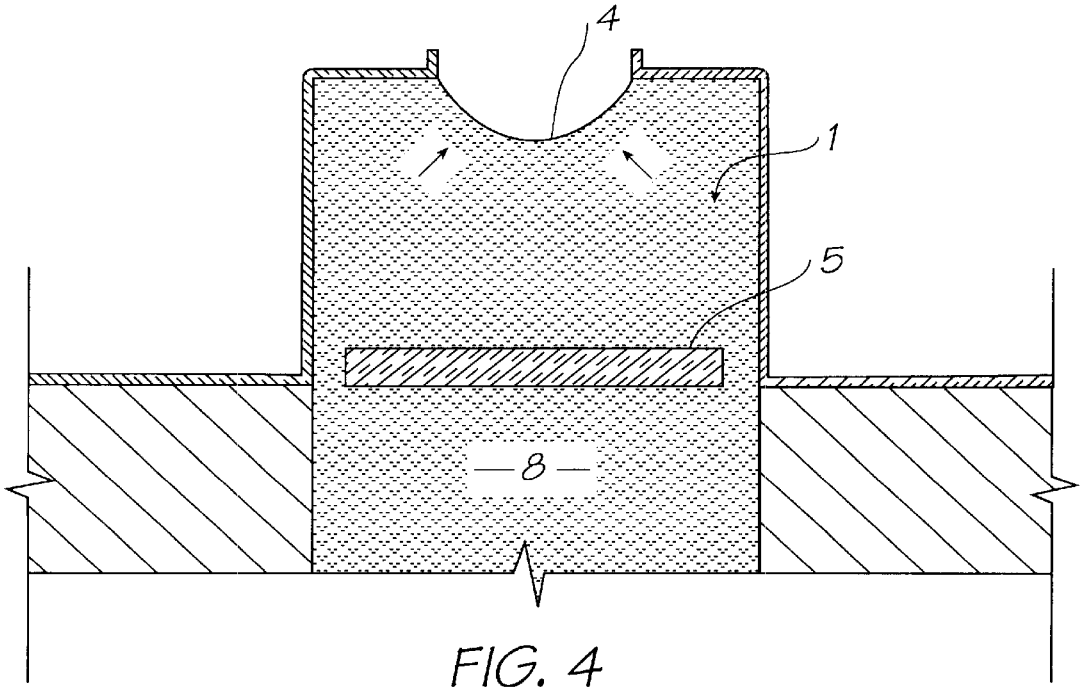

The chamber includes an internal paddle 5 which can be activated by means of a thermal bend actuator as described in the aforementioned application. The particular technique to actuate the internal paddle 5 can indeed be varied depending on manufacturing requirements. When it is desired to eject a drop of fluid, typically ink, the paddle 5 is actuated, as shown in FIG. 2, so as to rapidly move in an upward direction. The rapid upward movement causes a substantial increase in pressure in the chamber 1 around the ink meniscus 4. The increase in pressure results in a general outflow of fluid out of the nozzle aperture 3. Subsequently, as illustrated in FIG. 2, the actuator is deactivated and the paddle 5 begins to rapidly return to its original position. The rapid return results in a substantial decrease in pressure of the fluid within chamber 1 which in turn results in a general necking and breaking of the ink meniscus 4 and the formation of a drop 7 which proceeds to the printing media. Subsequently, as illustrated in FIG. 4, the chamber 1 is refilled by means of surface tension effects in meniscus 4 drawing ink into the chamber 1 from an ink supply channel 8 located below the paddle 5.

It is often highly desirable to provide for as rapid as possible refill of the chamber to allow fast printing speeds. Unfortunately, the surface tension effects of the ink meniscus drawing ink into the chamber 1 tend to operate in a very slow manner and provide a limiting effect on the elapsed period until the chamber is again able to fire, when the state illustrated in FIG. 1 is again reached.

The present invention is directed at profiling the chamber wall so as to allow for faster refill. The profiling can be done during manufacturing using MEMS techniques by means of a re-entrant etch of a sacrificial layer utilized in constructing the chamber walls.

Figure 5:
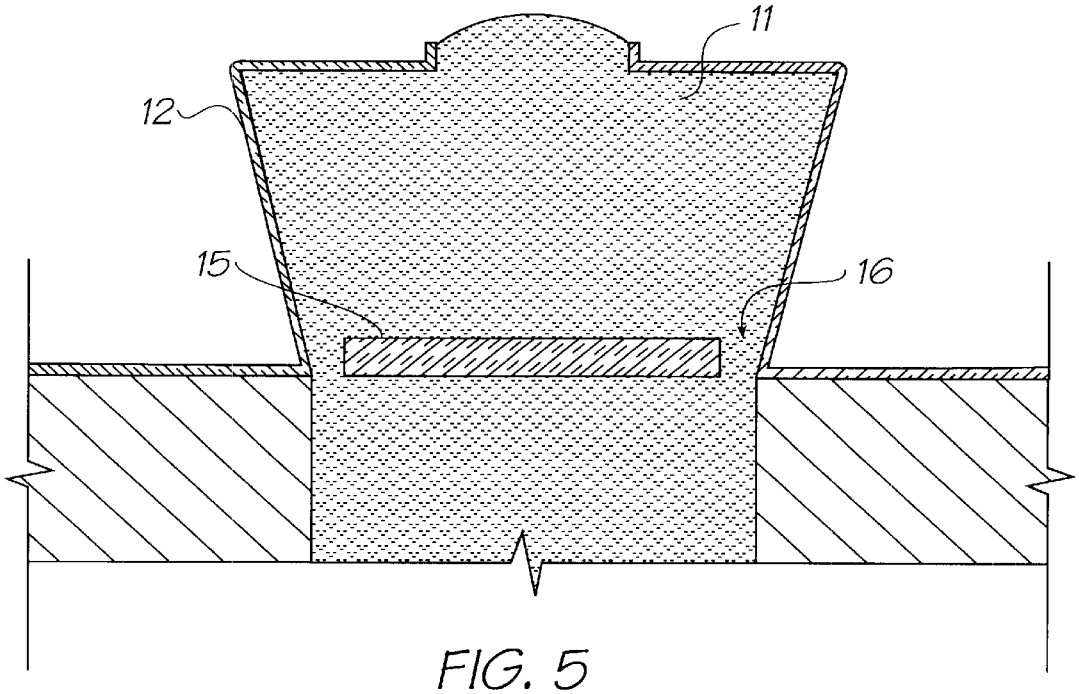
FIGS. 5–8 are corresponding views to FIGS. 1–4 respectively illustrating the operation of the present invention.

The operation of the present invention will now be discussed with reference to FIG. 5–FIG. 8, with FIG. 5 showing the modified arrangement including chamber 11 having sloping side walls 12. For an equivalent drop size ejection, the chamber 11 is slightly larger than nozzle chamber 1 with the paddle 15 being slightly larger than the paddle 5.

Figure 6:
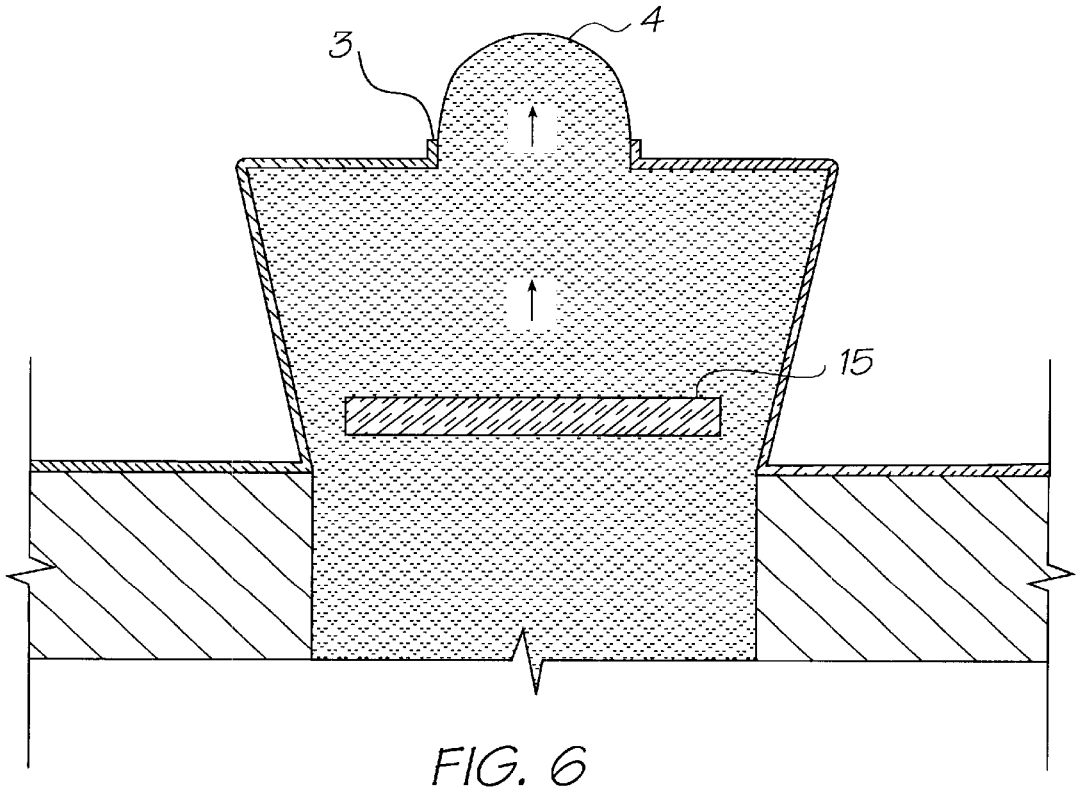
Figure 7:
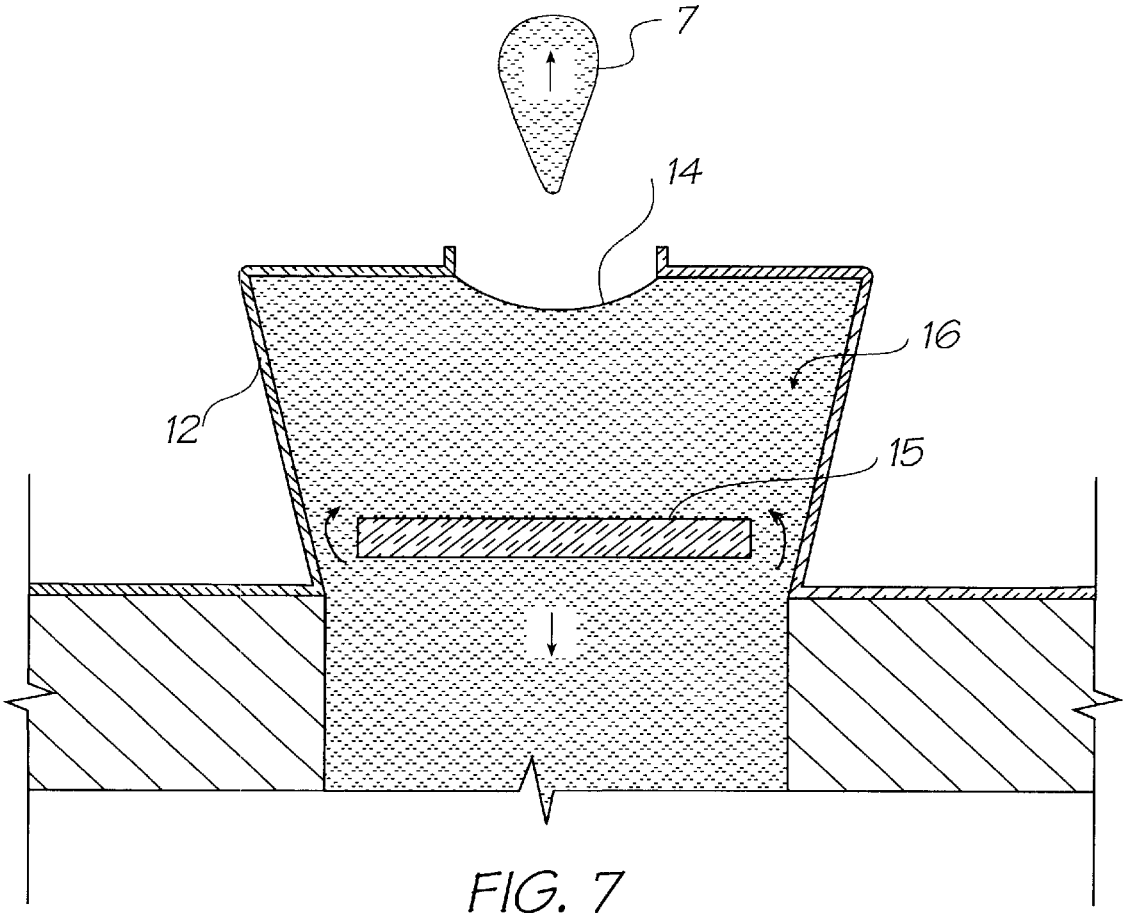
Figure 8:
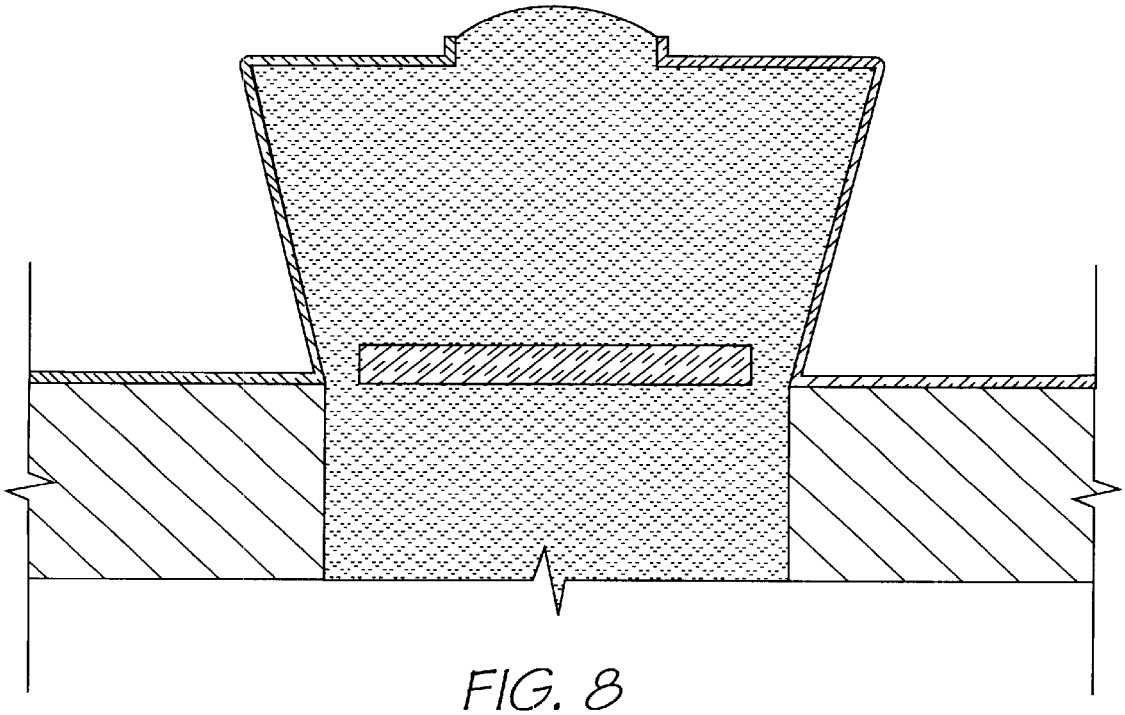

In the quiescent position, the gap 16 between the periphery of paddle 15 and the adjacent wall of the chamber can be relatively substantially unchanged. Initially, as illustrated in FIG. 6, the paddle 15 is activated to move in an upward direction thereby causing the ink meniscus 4 to bulge out of the chamber with a flow of ink proceeding through the nozzle aperture 3. Subsequently, as illustrated in FIG. 7, the paddle is deactivated resulting in the breaking off of a fluid bubble 7. However, the sloping side walls 12 result in a substantially enlarged gap 16 between the paddle 15 and the chamber wall. In the return pass, a substantial amount of fluid flows around the periphery of paddle 15 which results in the meniscus 14 being of substantially smaller dimensions than the meniscus 4 of FIG. 3. The overall result is a much quicker refill of the chamber and a more rapid return to the quiescent state as is illustrated in FIG. 8.

By altering the shape of the chamber walls a substantial reduction in the time in which chamber refill occurs can be provided and therefore much higher speed of operation achieved.

As mentioned previously, the chamber walls can be formed via re-entrant etching of the surface layer before deposition of the chamber walls in accordance with the aforementioned described manufacturing techniques.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

I claim:

1. A nozzle arrangement for an ink jet printhead, the nozzle arrangement comprising side walls and a roof wall that define an ink chamber and a nozzle aperture defined in the roof wall for the ejection of ink, the side walls and the roof wall being configured so that a cross sectional area of the ink chamber increases continually towards the nozzle aperture; and a moveable paddle that is positioned within said chamber, said paddle being displaceable between a first distal position and a second proximal position with respect to the nozzle aperture to eject ink from the nozzle aperture.

2. A nozzle arrangement as claimed in claim 1 wherein said side walls define a divergent profile.

3. A nozzle arrangement as claimed in claim 1 which is the product of an integrated circuit fabrication technique, wherein said ink chamber is the product of a re-entrant etching process carried out on a sacrificial layer utilized in forming said side and roof walls.

* * * * *